United States Patent [19]

Kella

[11] 4,074,375

[45] Feb. 21, 1978

[54] UTILITY SECURITY BLANKET

[76] Inventor: Harry Y. Kella, P.O. Box 483, La Mesa, Calif. 92041

[21] Appl. No.: 752,027

[22] Filed: Dec. 20, 1976

Related U.S. Application Data

[63] Continuation-in-part of Ser. No. 683,914, May 5, 1976, abandoned.

[51] Int. Cl.[2] ..... A47G 23/00; A47G 9/00

[52] U.S. Cl. ..... 5/336; 5/92; 5/334 R

[58] Field of Search ..... 5/92, 317 R, 334 R, 5/336

[56] References Cited

U.S. PATENT DOCUMENTS

| | | | |
|---|---|---|---|
| 1,061,259 | 5/1913 | Blofield | 5/336 |
| 1,538,596 | 5/1925 | Schroedter | 5/334 R |
| 1,875,525 | 9/1932 | Thexton et al. | 5/334 C |
| 2,730,728 | 1/1956 | Roberts | 5/334 R |
| 3,636,575 | 1/1972 | Smith | 5/334 C |
| 3,965,504 | 6/1976 | Ainsworth | 5/334 C |

FOREIGN PATENT DOCUMENTS

| | | | |
|---|---|---|---|
| 275,138 | 11/1965 | Australia | 5/336 |

*Primary Examiner*—Casmir A. Nunberg
*Attorney, Agent, or Firm*—Roy L. Knox

[57] ABSTRACT

A utility security blanket for restraining a patient from throwing off the bed clothes or from getting out of bed, and as a utility blanket simultaneously functioning as a comfortable bed cover, this blanket being rectangular and provided with strong straps extending lengthwise of the blanket as well as straps extending crosswise thereof, the latter having extensions easily detached from the blanket by an attendant when not required, but ordinarily secured to the bed frame. A further feature of the blanket is that it can be opened or separated partially or end to end, by an attendant, for emergency or merely simplified release of the patient, or for providing access to the patient, without untying the strap extensions from the bed frame, the opening being closer to one lateral edge than the other for convenience and the zipper slider being secreted under a small flap for precautionary reasons.

3 Claims, 4 Drawing Figures

UTILITY SECURITY BLANKET

This application is a continuation-in-part of application Ser. No. 683,914 filed May 5, 1976 by the same applicant now abandoned.

BACKGROUND OF THE INVENTION

Patient-restraining means for use with beds has in the past often taken the form of strong bands or straps, often of canvas-like material fastened to the bed and occasionally to the patient. The bands or straps in the prior art have sometimes have been incorporated in some degree with panels of strong sheet material and sometimes with panels of bed clothing material such as disclosed in two of the patents cited as references in the above mentioned parent application. The background also includes restraining blankets and crib covers with closable openings therein and the use of zippers to close these openings. There is a need, however, for a restraining blanket which in any emergency can be completely and very quickly divided to free a bed patient, or merely to facilitate unrestricted access thereto, without untieing the restraining straps, and there is a further need for a blanket which can be converted easily from a restraining blanket, possibly required for night use, to a substantially normal use bed cover by the easy removal of strap portions, as may be desirable for day use by the same patient for psychological and other considerations.

SUMMARY OF THE INVENTION

As claimed, the instant invention is an adequate response to the above mentioned need, the blanket being completely separable into two discrete portions along a line extending the full length of the blanket, straps being incorporated into the blanket on each side of the line of division and having strap extensions securable to a bed frame, these straps being easily removable to convert the restraining blanket to a substantially conventional bed covering. The separation of the blanket into two portions is accomplished by a slide fastener with the slider being concealed to discourage tampering therewith by the patient.

DETAILED DESCRIPTION OF A PREFERRED EMBODIMENT

Figure 1:
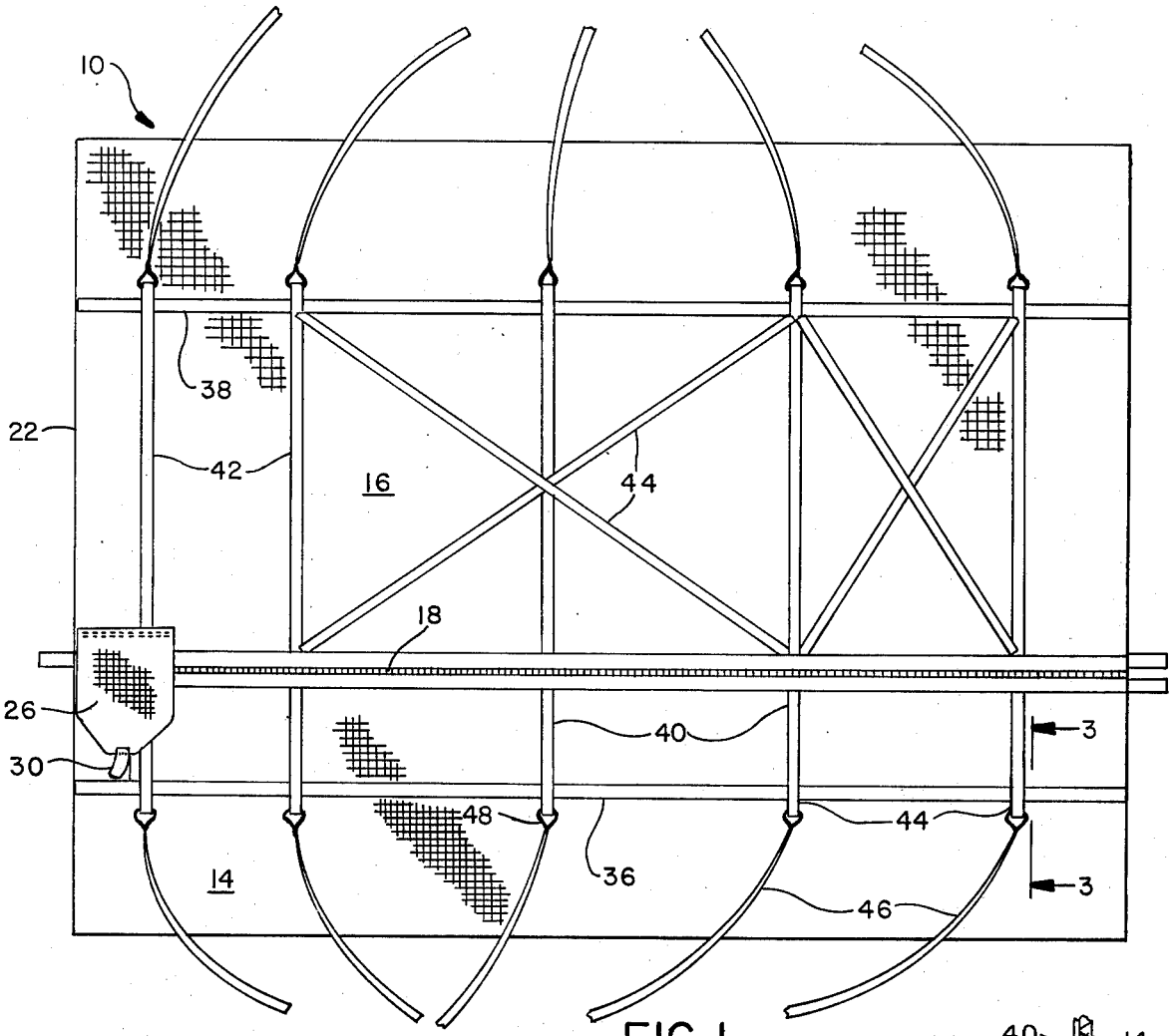
FIG. 1 is a plan view of the blanket fully extended and with the zipper closed and concealed.
Figure 2:
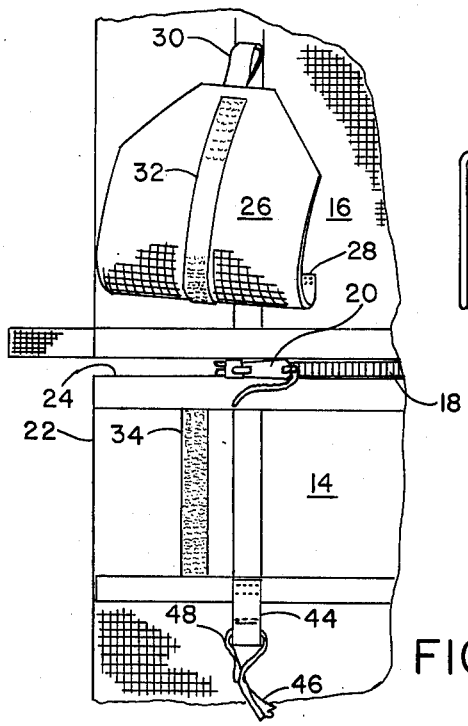
FIG. 2 is an enlarged fragmentary view of the divided end portion of the blanket and the zipper at the end of its travel and with the protective flap turned back.
Figure 4:
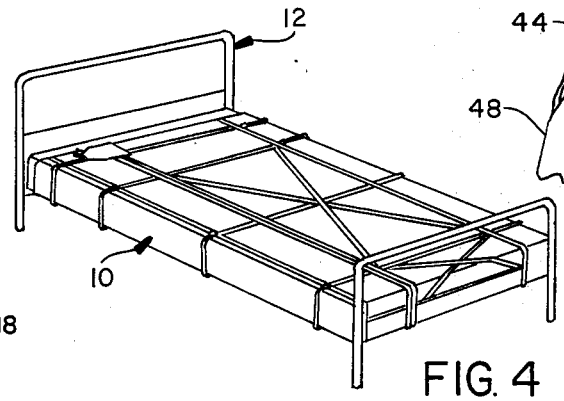
FIG. 4 is a somewhat diagrammatic view illustrating the blanket as applied to a hospital bed.

Referring now to the drawing in which the numerals relate to similar or identical elements throughout the several views, the numeral 10 indicates the blanket generally and the environment wherewith the blanket will be used will ordinarily be a bed 12 to the frame of which the blanket will be secured or a smaller sized blanket will be secured to a geriatric medical lounge chair, not illustrated, for very similar purposes.

The blanket 10 will ordinarily be a simple rectangular panel of bed clothing material divided longitudinally into two discrete portions 14 and 16. The line of division is offset from the median position so that the portion 16 is considerably larger than the portion 14, and in practice the line of division will be considerably closer to one side of the bed than the other for the convenience of the attendants, and of the bed patient as well, especially when getting into or out of bed. A slide fastener 18, generally referred to as a zipper, connects the two portions and it will be noted that the slider 20 of the zipper is located at the limit of its travel toward the end 22 of the blanket, and that the blanket is permanently divided at the end 22 as at 24, that is, there is no zipper at the split portion 24 which will ordinarily be from two to six inches in length.

A flap 26, preferably of material similar to that of the main portion of the blanket, is sewn to the latter along one edge of the flap as at 28, and positioned so that when closed this flap conceals the slider 20 and also effectively closes the split portion 24 of the blanket. The purpose of the flap in concealing the zipper slider 20 is, of course, to discourage tampering therewith by the patient, but the flap has an opening tab 30 and is held closed only by self-closure means 32–34 such as that sold under the trademark VELCRO.

Longitudinally extending restraining straps 36–38 are secured, as by sewing, to the surface of the blanket, in each of the portions 14 and 16, respectively, and transverse restraining straps 40 and 42 intercept the straps 36 and 38, respectively. In addition, similar straps may be used to reinforce the fabric portions of the slide fastener 18, and diagonal restraining straps 44 are added to reinforce the central panels of the blanket.

Figure 3:
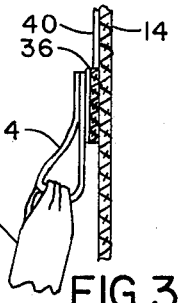
FIG. 3 is an enlarged sectional view taken on line 3—3 of FIG. 1.

If reference is made to FIG. 3 it will be noted how each of the transverse straps 40 and 42 are each provided with a terminal loop 44, preferably sewn to the junctures of the longitudinal and transverse straps. An equal number of strap extensions 46 are releasibly secured by looping the ends 48 thereof through the loops 44, said ends 48 being provided with self-interconnecting means of suitable nature such as that sold under the trademark VELCRO, and said strap extensions are, of course, used to tie the blanket to the bed frame or geriatric lounge chair as may be required to prevent inadvertent or intentional removal by a patient. When not required, it is a simple matter to remove the strap extensions 46 so that the blanket can be used therewithout while still retaining the functionality of an easily divisible blanket by reason of the slide fastener 18.

What is claimed as new and desired to be secured by Letters Patent is:

1. A blanket comprising a simple rectangular single thickness panel of bed clothing material suitable for use as an above-the-body blanket only and having means for easy separation thereof into two discrete portions;

said means being capable of easy re-uniting said portions to reconstitute the blanket;

straps secured to and extending over said blanket with strap extensions at opposite sides of said blanket for securement to a bed frame, whereby the blanket functions as a restraining means;

said strap extensions having means for easy detachment from said straps;

said means for separation into portions being a slide fastener extending along a line effectively from end to end of the blanket and said straps also being discontinuous along said line so that the blanket can be separated into two portions, by an attendant, without untieing said strap extensions.

2. A blanket according to claim 1 wherein said slide fastener has a slider and said blanket has a short permanently split portion in line with and at one end of said slide fastener;

said blanket also having a small flap normally overlapping and concealing said slider and split portion when the blanket is disposed as in use, to discourage tampering therewith by a patient; and means for releasibly fastening said flap in position over said slider.

3. A blanket according to claim 1 wherein said means for easy detachment comprises loops on said straps and terminals on the strap extensions insertable through said loops and fastened thereon by self-interconnecting means commercialized under the trademark VELCRO.

* * * * *